US011408200B1

(12) United States Patent
Capehart et al.

(10) Patent No.: US 11,408,200 B1
(45) Date of Patent: Aug. 9, 2022

(54) APPARATUS AND METHOD TO VISUALLY DECIPHER A KEYED LOCK CYLINDER

(71) Applicants: Keith Capehart, Biloxi, MS (US); Brian Capehart, Gulfport, MS (US)

(72) Inventors: Keith Capehart, Biloxi, MS (US); Brian Capehart, Gulfport, MS (US)

( * ) Notice: Subject to any disclaimer, the term of this patent is extended or adjusted under 35 U.S.C. 154(b) by 0 days.

(21) Appl. No.: 17/452,473

(22) Filed: Oct. 27, 2021

Related U.S. Application Data

(63) Continuation of application No. 16/948,764, filed on Sep. 30, 2020, now Pat. No. 11,208,830.

(60) Provisional application No. 62/704,827, filed on May 29, 2020.

(51) Int. Cl.
*E05B 19/20* (2006.01)

(52) U.S. Cl.
CPC ..... *E05B 19/205* (2013.01)

(58) Field of Classification Search
CPC ..... E05B 19/205
See application file for complete search history.

(56) References Cited

U.S. PATENT DOCUMENTS 4,517,746 A * 5/1985 Easley ..... E05B 19/205 70/394
5,172,578 A * 12/1992 Bitzios ..... E05B 19/205 70/394
5,224,365 A * 7/1993 Dobbs ..... E05B 27/0082 70/394
5,325,691 A * 7/1994 Embry ..... E05B 19/205 70/394
5,355,701 A * 10/1994 Tobias ..... E05B 27/0028 70/394
6,021,655 A * 2/2000 Labbe ..... E05B 19/205 70/493
6,134,928 A * 10/2000 Kang ..... E05B 19/205 70/394
6,230,529 B1 * 5/2001 Persson ..... E05B 19/205 70/394
6,415,523 B1 * 7/2002 Wood ..... E05B 19/0011 33/539
6,960,991 B2 * 11/2005 Orcifalvi ..... G07C 9/00817 340/5.6
10,400,475 B2 * 9/2019 Klammer ..... E05B 45/06
11,208,830 B2 * 12/2021 Capehart ..... E05B 19/205
2010/0236085 A1 * 9/2010 Capehart ..... G01B 5/0018 33/540

* cited by examiner

*Primary Examiner* — Bayan Salone
(74) *Attorney, Agent, or Firm* — Dunlap Bennett & Ludwig, PLLC; Brendan E. Squire

(57) ABSTRACT

An apparatus and method for digital decoding and deciphering a lock cylinder pin configuration, such as for a Kwikset or a Smart Key lock is disclosed. The digital decoder includes a light source placed inside of the keyhole that eliminates glare from the face of the lock and improves the decoding process. A digital camera is configured to provide an optical view of an interior of the lock cylinder to detect the pin settings for each of a plurality of lock tumbler pins carried by the lock cylinder. The digital camera is configured to provide a live feed displayed on a video screen or recorded for later analysis.

19 Claims, 5 Drawing Sheets

APPARATUS AND METHOD TO VISUALLY DECIPHER A KEYED LOCK CYLINDER

CROSS-REFERENCE TO RELATED APPLICATION

This application is a continuation of U.S. patent application Ser. No. 16/948,764, filed Sep. 30, 2020, and claims the benefit of priority of U.S. provisional application No. 62/704,827, filed May 29, 2020, the contents of which are herein incorporated by reference.

BACKGROUND OF THE INVENTION

The present invention relates to keylocks, and more particularly to fitting a key to a key lock cylinder for which the key has been lost or is otherwise not available.

Keyed lock cylinders and rekeyable lock cylinders, such as The Kwikset Smart Key locks are very difficult to unlock when the key is not accessible. The process of unlocking these locks when no key is available often requires destructive measures to the lock itself.

Lock cylinder decoders have been attempted. However, current lock cylinder decoders are not digital and require the user's eyesight and to have their view aligned in line with the keyhole to look through a magnifying lens. These decoders also are illuminated from outside of the lock, limiting visibility of the pins within the lock cylinder. Nonetheless, the speed and efficiency of creating a key for the cylinder utilizing these decoders is reliant on the skill and abilities of the locksmith.

As can be seen, there is a need for an improved apparatus and methods for decoding a keyed lock cylinder. Having the light source placed inside of the keyhole eliminates glare from the face of the lock during the decoding process.

SUMMARY OF THE INVENTION

In one aspect of the present invention, a lock cylinder decoding apparatus for decoding a lock cylinder of a lock is disclosed. The lock cylinder decoding apparatus includes a housing having a proximal end and a distal end. A camera is mounted within the proximal end of the housing. A modified key is removably coupled to the distal end, the modified key having a profile dimensioned to fit a corresponding profile of the lock cylinder. A channel defined within the profile has an opening to a pin side of the lock cylinder. A mirror is attached at a distal end of the channel. The mirror is angled to orient a sight line of the camera on a selected pin of a plurality of pins carried by the lock cylinder to provide a visual observation of the selected pin by the camera.

In some embodiments, a camera lens is configured to provide a point of focus on the selected pin carried within the lock cylinder. The camera lens may protrude into a base of the modified key.

In some embodiments, a light source is oriented along the sight line of the camera to illuminate the selected pin. The light source is carried by the modified key. The light source may be carried within the channel.

In some embodiments, an electrical contact between the modified key and the handle is provided to power the light source.

In some embodiments, a plurality of spacers corresponding to the plurality of pins carried by the lock cylinder is provided. Each of the plurality of spacers is configured to be coupled to the modified key. Each of the plurality of spacers has thickness to position the mirror for observation of the selected pin corresponding to a selected one of the plurality of spacers.

In some embodiments, the mirror is attached at a distal end of the channel corresponding to a last pin of the plurality of pins carried by the lock cylinder.

In other embodiments, the camera is preferably a digital camera. A display is coupled to the digital camera.

In yet other embodiments, a wireless communications module is configured for communication with a mobile computing device.

In other aspects of the invention, a method of decoding a lock cylinder having a plurality of pins is disclosed. The method includes inserting a modified key that removably coupled to the distal end of a lock cylinder decoding device into the lock cylinder. The modified key having a profile dimensioned to fit a corresponding profile of the lock cylinder. A channel is defined within the profile has an opening to a pin side of the lock cylinder. A mirror is attached at a distal end of the channel, such that the mirror is angled to orient a sight line of a camera carried by the lock cylinder decoding device on a distal pin of the plurality of pins to provide a visual observation of the selected pin by the camera.

In some embodiments, the method includes applying a spacer to the modified key. The spacer is selected from a plurality of spacers that are dimensioned to position the sight line of the camera on each of a preceding pin of the plurality pins in the lock cylinder.

In some embodiments, the method includes observing a pin depth of each of the plurality of pins in the lock cylinder by the camera.

The method may also include cutting a key based on the pin depth of each of the plurality of pins in the lock cylinder.

These and other features, aspects and advantages of the present invention will become better understood with reference to the following drawings, description and claims.

DETAILED DESCRIPTION

The following detailed description is of the best currently contemplated modes of carrying out exemplary embodiments of the invention. The description is not to be taken in a limiting sense, but is made merely for the purpose of illustrating the general principles of the invention.

Broadly, embodiments of the present invention provide a key decoder for a keyed lock cylinder. The key decoder is utilized to decipher a pin configuration of a keyed lock cylinder that can be utilized to make a replacement key for a keyed lock cylinder.

Figure 1:
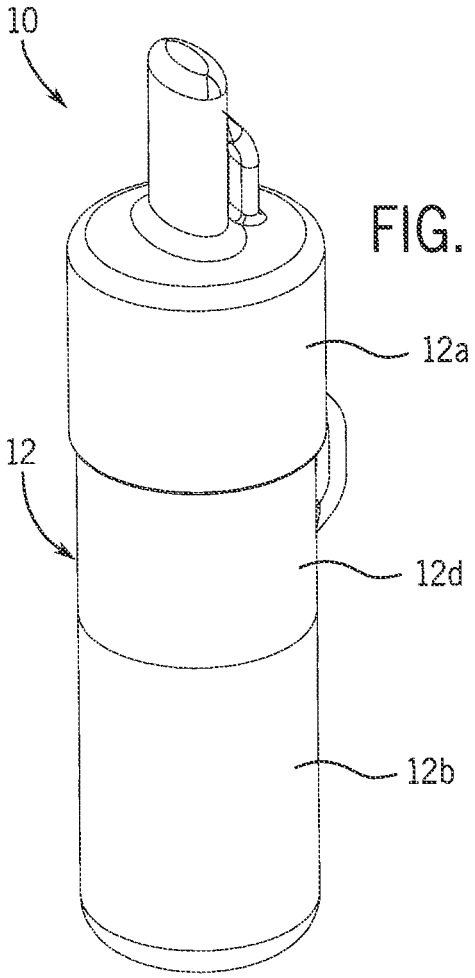
FIG. 1 is a perspective view of the lock decoder.
Figure 2:
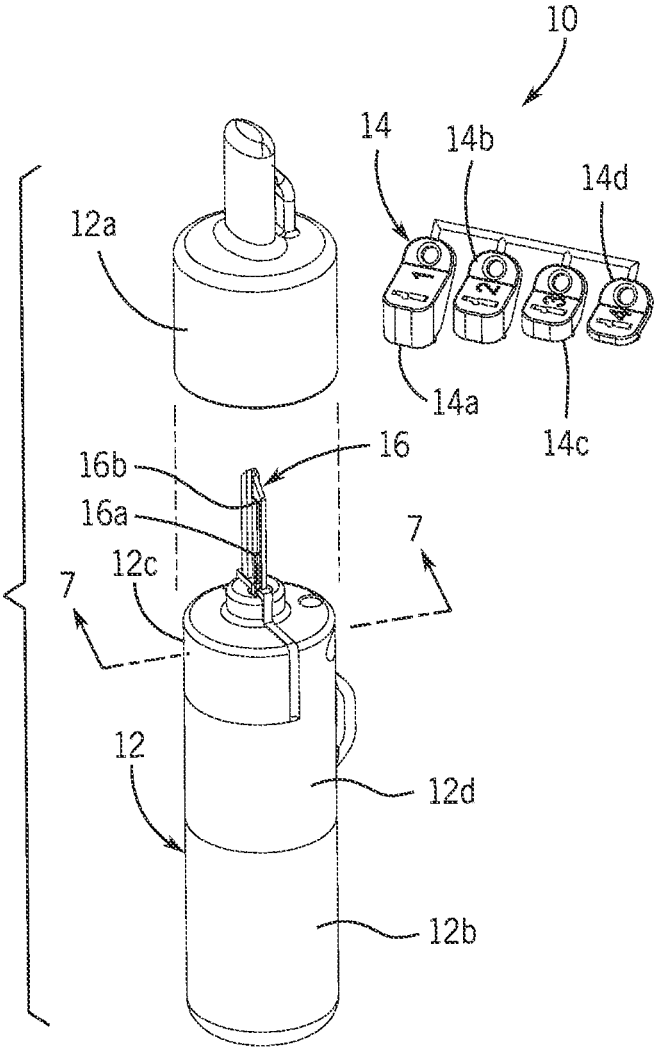
FIG. 2 is an exploded perspective view of the lock decoder.
Figure 3:
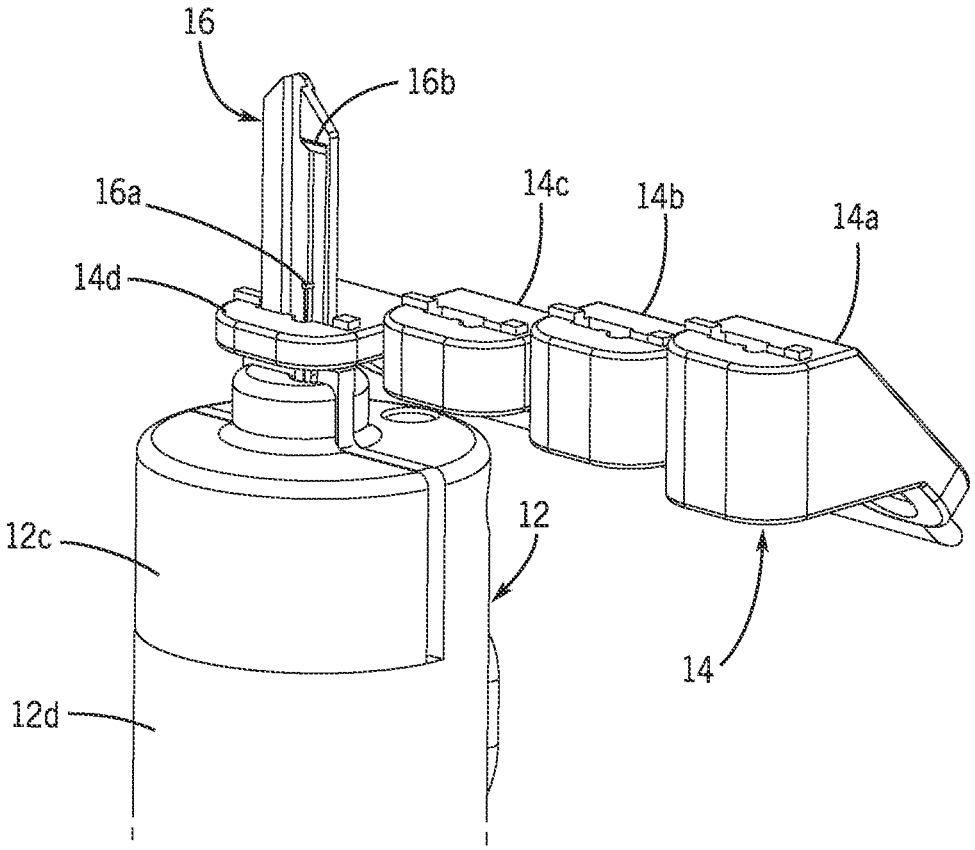
FIG. 3 is a detailed perspective view of the lock decoder.
Figure 4:
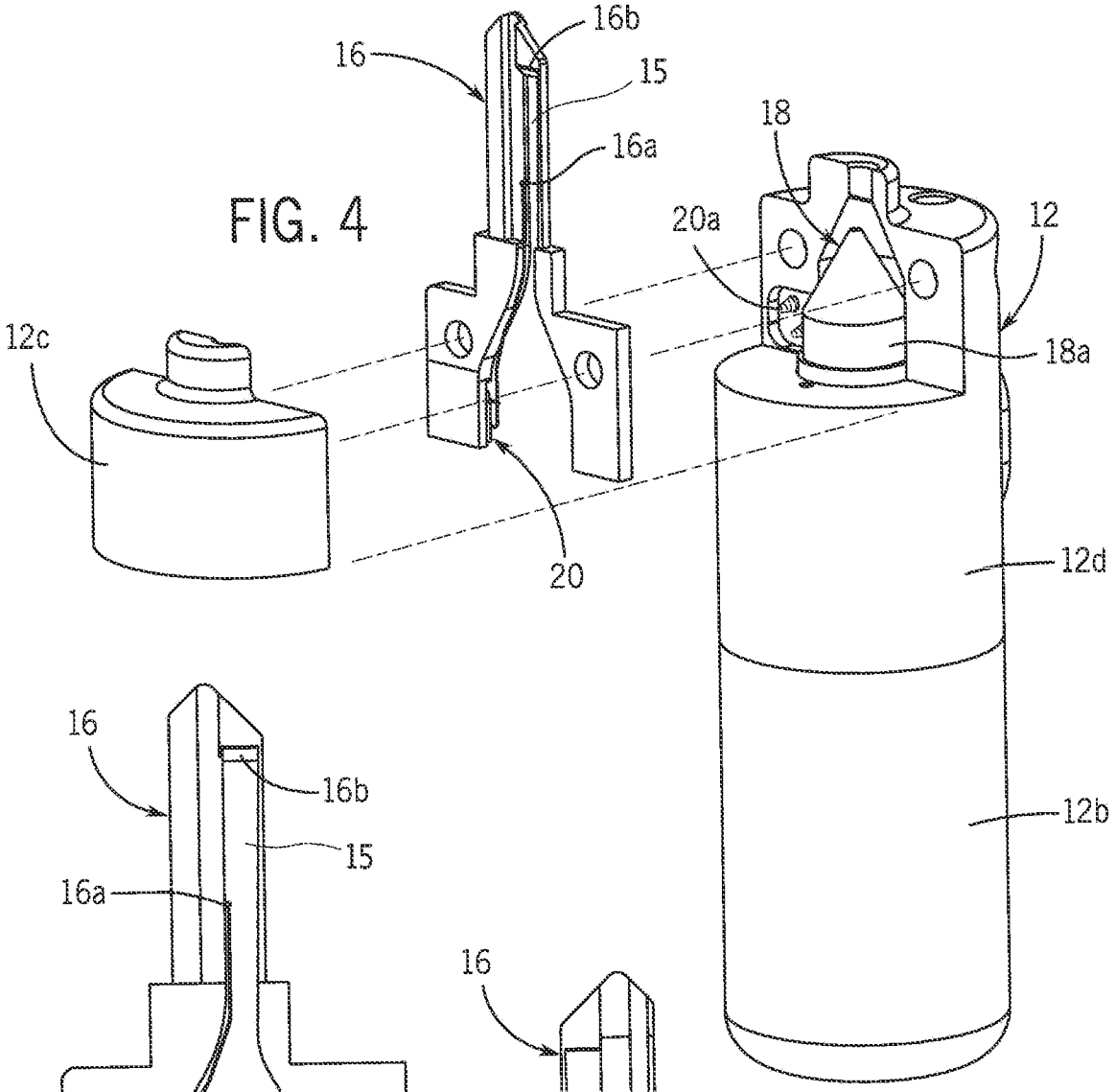
FIG. 4 is an exploded perspective view of the lock decoder.
Figure 5:
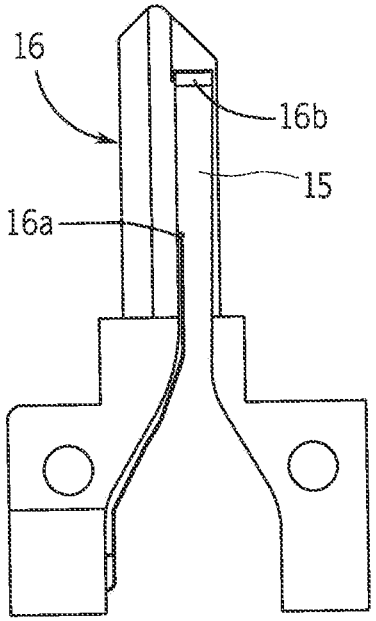
FIG. 5 is a front elevation view of the key of the lock decoder.
Figure 6:
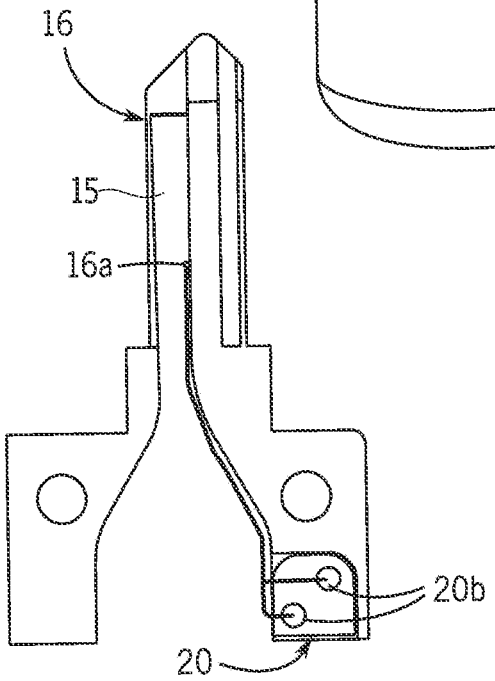
FIG. 6 is a rear elevation view of the key of the lock decoder.
Figure 7:
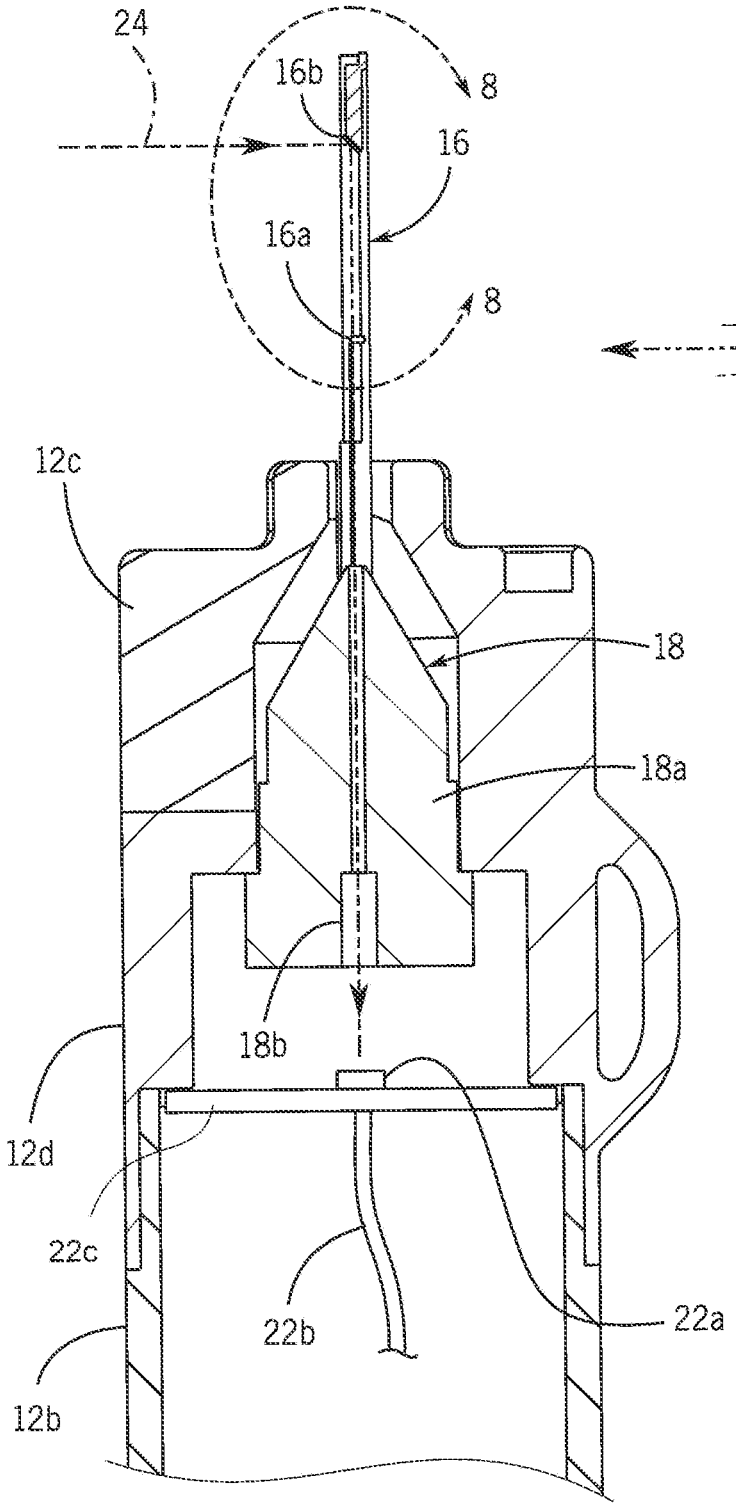
FIG. 7 is a cross sectional view taken on line 7-7 of FIG. 2.
Figure 8:
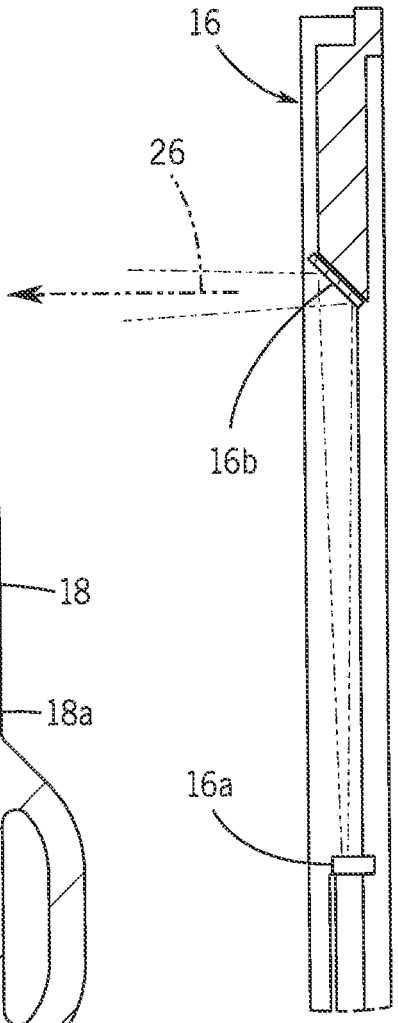
FIG. 8 is a detail cross sectional view indicated by line 8-8 of FIG. 7.
Figure 9C:
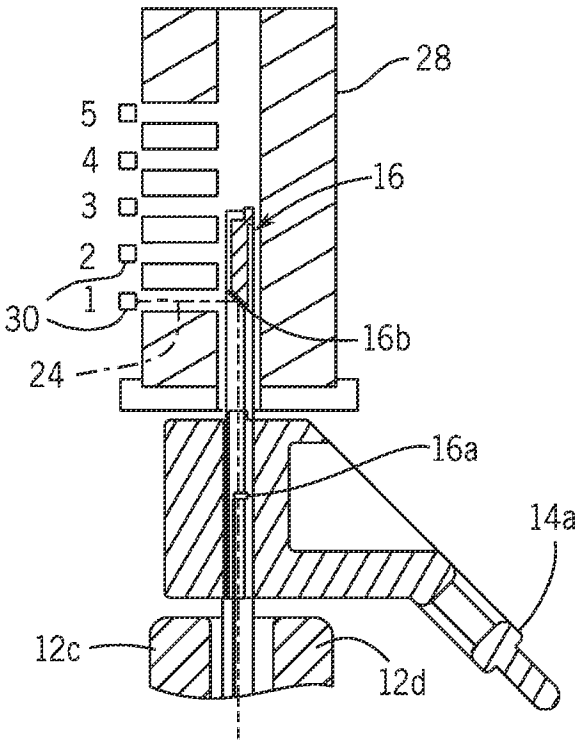
FIG. 9A-9C are detail a cross sectional views of the lock cylinder and spacers.
Figure 9B:
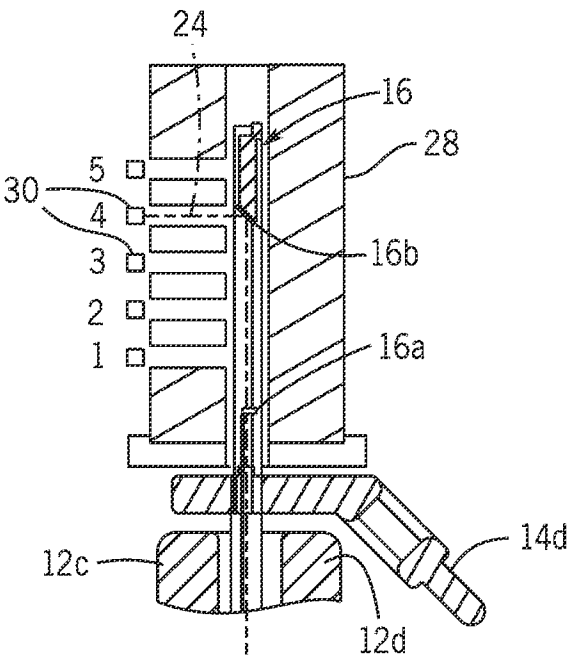
Figure 9A:
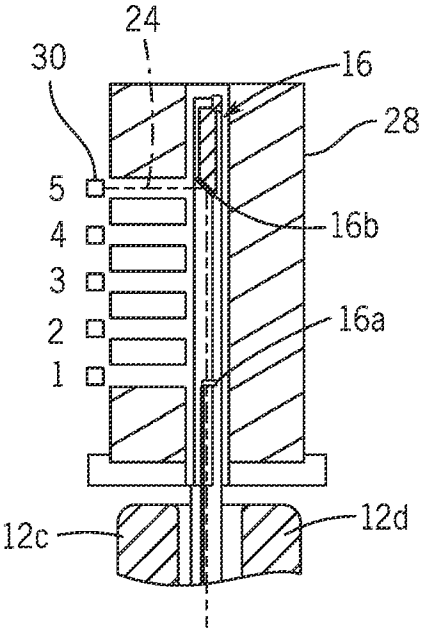
Figure 10:
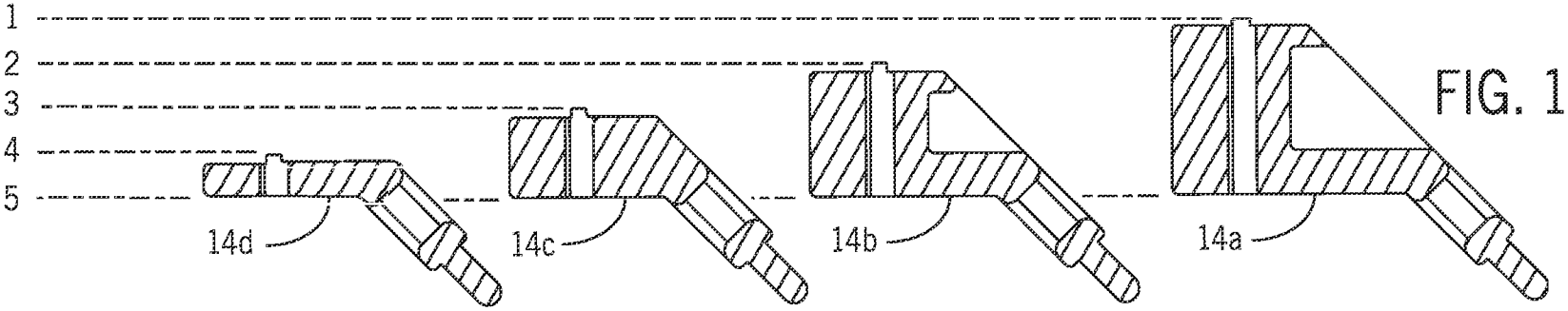
FIG. 10 is a composite view showing spacers of the invention in cross section.

A non-limiting embodiment of a key decoder according to aspects of the present invention is shown in reference to the drawings of FIGS. 1-10. The lock decoder device 10 may include a camera body 12*b* that is carried in a housing 12*d*, the camera body 12 and housing 12*d* forming a handle having a proximal end and a distal end. A modified key 16 is coupled to the distal end and is configured to allow a camera inspection of a plurality of pins carried within a lock cylinder 28, to decipher the pins. The user can hold the proximal end of the handle to manipulate the modified key 16 in the lock cylinder 28.

The camera body 12*b* includes a camera circuit board 22*c* carrying circuitry to control a camera 22*a* interconnected by a wiring harness 22*b*. The camera 22*a* includes a lens assembly 18 that has a lens body 18*a* and a lens 18*b*. The lens assembly 18 is configured to provide a point of focus on a selected pin carried within the lock cylinder 28. Preferably the camera 22*a* is a digital camera. A cover 12*a* may be provided to cover a distal end of the device 10.

The camera body 12*b* may include one or more of a WIFI, a Bluetooth, or a USB connection to convey images captured by the camera 22*a* to an output device, such as a display or printing device. The camera body 12*b* may have an internal battery or the device may operate off a wired connection to an external power source mounted to the housing 12*d*. The camera circuit board 22*c* may be mounted with screws or otherwise secured within the housing 12*d* and is interconnected to the camera body 12*b* by the camera wire harness 22*b*.

The lens assembly 18 may also mounted within the housing 12*d* with screws. A light source circuit board 20 may also be affixed to the housing 12*d*. The light source circuit board 20 may have springs 20*a* soldered to it acting as electrical contacts between the light source circuit board 20 and the camera circuit board 22*a* which are connected to each other by the housing wire harness 22*b*.

The modified key 16 is dimensioned to fit within a profile of the lock cylinder 28 to be decoded and is designed to carry the light source 16*a* and a mirror 16*b*. As will be appreciated a plurality of modified keys 16 may be provided to fit the profile of various lock cylinders 28.

A channel 15 is defined within the modified key 16 and opens to a pin side of the lock cylinder 28. The modified key 16 includes a mirror 16*b* that is mounted at a distal end of the channel 15 at roughly a 45-degree angle in line with a sight line 24 of the digital camera 22*a* and lens assembly 18. Preferably, the angle is selected to be slightly off the 45-degree angle to avoid excessive glare being reflected back the lens assembly 18 to the digital camera 22*a*. The light source 16*a*, light source wiring harness, and light source circuit board 20 may also be mounted to the modified key 16.

A plastic cover plate 12*c* may be attached to the housing 12*d* to protect the lens assembly 18, modified key 16, as well as help keep dust out of the camera 22*a*. In the case of a digital camera 22*a*, a digital video signal captured by the lens assembly 18 may be transmitted by either wired or wireless communications to a display screen which can be one or more of a smart phone, a PC, or a dedicated LCD display panel.

A plurality of wafer alignment spacers 14*a-n* are provided. In the non-limiting embodiment shown, for example, a first spacer 14*a*, second spacer 14*b*, third spacer 14*c*, and fourth spacer 14*d* are provided. The plurality of wafer alignment spacers 14*a*-14*n* are used for alignment purposes to gauge how far the modified key 16 is inserted in the lock cylinder 28 during the decoding process. As will be appreciated, there are many other ways the alignment steps could be made, however the inventors have found this method to be simple and effective.

In use, the lock decoder device 10 is placed in a powered-on condition. When applicable, a smart phone or other display is then connected to the lock decoder device 10, such as by a WIFI signal or a wired connection. A corresponding app on the phone is then opened for viewing and in some embodiments, recording a video feed of the lock decoder device 10.

The modified key 16 is then fully inserted into the lock cylinder 28 that is to be decoded until it comes to a stop, thereby placing the modified key 16 in the correct position to decode the first of a plurality of pins in the lock cylinder 28 that will need to be decoded to make a replacement key.

The light source 16*a* on the modified key 16 can be dimmed or brightened, as needed by turning a dial on the device 10 to accommodate the best lighting conditions. The video feed can be digitally magnified on the display to further accommodate viewing.

Each of the plurality of pin positions to be decoded within the lock cylinder 28 has the possibility of having a plurality of different key cut depths. By way of example, in the KwikSet® lock, there are six key cut depths that all look uniquely different from each other when viewed from within the lock cylinder 28.

The viewing screen or captured video signal is then analyzed by the user and the cut depth for the first position being decoded is then recorded by either the app taking a picture of that position for later analysis or the user writing down one of the six cut depth possibilities. Likewise, the video signal maybe recorded during the decoding process for subsequent analysis.

The modified key 16 is then withdrawn from the lock and second spacer 14*b* is inserted on to the modified key 16. The modified key 16 is then fully reinserted into the lock cylinder 28 fully until it comes to a stop. The modified key 16 is now in position to read the second of the plurality of pin positions in the lock cylinder 28. The correct cut depth for the second position being decoded is then recorded by either the app taking a picture of that position for later analysis or the user writing down one of the six cut depth possibilities.

The modified key 16 is again withdrawn from the lock cylinder 28 and the decoding steps are repeated using a subsequent spacers for each of the plurality of pin positions in the lock cylinder 28 to decode the remaining pin positions in the lock cylinder 28. Once all of the plurality of pin positions in the lock cylinder 28 are decoded, a key blank with the correct profile to enter the lock cylinder 28 can be cut using a standard key cutter that will then allow the replacement key to operate in the lock cylinder 28.

As will be appreciated from the present disclosure, greater resolution of the camera 12*b* would allow for more detailed images. Likewise, software could be developed that would allow the wafers to automatically be recognized and decode the pin configuration for the lock cylinder 28, simplifying the decoding process. The software can also be modified to allow a panoramic right-angle image of the interior of the lock cylinder 28 allowing for easier decoding.

The present invention would typically be used by a professional locksmith for gaining access to, or the replacement of keys when the key is no longer available to operate the lock cylinder 28.

It should be understood, of course, that the foregoing relates to exemplary embodiments of the invention and that modifications may be made without departing from the spirit and scope of the invention as set forth in the following claims.

What is claimed is:

1. A lock cylinder decoding apparatus for decoding a lock cylinder of a lock, comprising:

a cylinder probe having a proximal end and a distal end, the cylinder probe dimensioned to be received within a keyhole of the lock cylinder;

a channel defined within the cylinder probe has an opening to a pin side of the keyhole; and a mirror attached at a distal end of the channel, wherein the mirror is angled to orient a sight line aligned with the channel of the cylinder probe on a selected pin of a plurality of pins carried by the lock cylinder.

2. The lock cylinder decoding apparatus of claim 1, further comprising:

a camera removably coupled with the proximal end of the cylinder probe; and a camera lens configured to provide a point of focus on the selected pin carried within the lock cylinder.

3. The lock cylinder decoding apparatus of claim 2, wherein the camera lens protrudes into a base of cylinder probe.

4. The lock cylinder decoding apparatus of claim 1, further comprising:

a light source oriented along the sight line of the channel to illuminate the selected pin.

5. The lock cylinder decoding apparatus of claim 4, wherein the light source is carried within the cylinder probe.

6. The lock cylinder decoding apparatus of claim 5, wherein the light source is carried within the channel.

7. The lock cylinder decoding apparatus of claim 2, further comprising:

an electrical contact between the cylinder probe and a housing carrying the camera.

8. The lock cylinder decoding apparatus of claim 1, further comprising:

a plurality of spacers corresponding to the plurality of pins carried by the lock cylinder, each of the plurality of spacers configured to be coupled with the cylinder probe, each of the plurality of spacers having a thickness to position the mirror for observation of the selected pin.

9. The lock cylinder decoding apparatus of claim 1, further comprising:

the mirror attached at the distal end of the channel, the channel having a depth corresponding to a last pin of the plurality of pins carried by the lock cylinder.

10. The lock cylinder decoding apparatus of claim 2, wherein the camera is a digital camera.

11. The lock cylinder decoding apparatus of claim 10, further comprising:

a display coupled to the digital camera.

12. The lock cylinder decoding apparatus of claim 11, further comprising:

a wireless communications module configured for communication with a mobile computing device.

13. A method of decoding a lock cylinder having a plurality of pins, comprising:

inserting a cylinder probe removably coupled to a distal end of a lock cylinder decoding device, the cylinder probe dimensioned to be received within a keyhole of the lock cylinder, a channel defined within the cylinder probe has an opening to a pin side of the lock cylinder, a mirror attached at a distal end of the channel, wherein the mirror is angled to orient a sight line aligned with the channel on a selected pin of a plurality of pins carried by the lock cylinder to provide a visual observation of the selected pin.

14. The method of decoding a lock cylinder of claim 13, further comprising:

coupling a camera with the cylinder probe; and imaging the selected pin.

15. The method of decoding a lock cylinder of claim 14, further comprising:

withdrawing the cylinder probe to orient the sight line on each pin of the plurality of pins in the lock cylinder.

16. The method of decoding a lock cylinder of claim 15, further comprising:

applying a spacer to the cylinder probe, the spacer selected from a plurality of spacers dimensioned to position the sight line on one of the plurality of pins in the lock cylinder.

17. The method of decoding a lock cylinder of claim 14, further comprising:

observing a pin depth of each of the plurality of pins in the lock cylinder by the camera.

18. The method of decoding a lock cylinder of claim 17, further comprising:

cutting a key based on the pin depth of each of the plurality of pins in the lock cylinder.

19. The method of decoding a lock cylinder of claim 14, further comprising:

selectively positioning the cylinder probe to observe a pin depth of each of the plurality of pins of the lock cylinder.

* * * * *